United States Patent [19]

McMullan

[11] 4,278,869

[45] Jul. 14, 1981

[54] INSTRUMENT MOUNTING FIXTURE

[76] Inventor: James P. McMullan, 2630 Seaman Ave., El Monte, Calif. 91733

[21] Appl. No.: 94,036

[22] Filed: Nov. 13, 1979

[51] Int. Cl.[3] ..... H05B 3/00

[52] U.S. Cl. ..... 219/217; 5/422; 219/328

[58] Field of Search ..... 5/421, 422; 248/27.1, 248/313, 316; 219/217, 328

[56] References Cited

U.S. PATENT DOCUMENTS

| | | | |
|---|---|---|---|
| 2,461,114 | 2/1949 | Goldberg | 248/316 A |
| 2,958,496 | 11/1960 | Johnson | 248/313 |
| 4,064,387 | 12/1977 | McMullan | 5/422 |

*Primary Examiner*—Casmir A. Nunberg
*Attorney, Agent, or Firm*—Georges A. Maxwell

[57] ABSTRACT

A mounting fixture to mount a box-like electric heater control unit on the lower rigid wooden frame structure of a box-spring to support the control unit adjacent one side of the box-spring above the plane of the frame structure for convenient visual monitoring and manual operation; the box spring includes resilient and flexible spring and pad structure overlying the frame to support a heater and a mattress and which affords no suitable structure for mounting a heater control unit; the fixture is a unitary sheet metal part with a lower frame engaging portion, an upper control unit mounting portion and an intermediate portion orienting the upper portion above and laterally outward of the lower portion; the control unit is a box-like unit having a rear wall with fastener receiving openings, a manually engageable control part and elongate power cords extending to an electric heater above the box spring and to a remote power source; the upper portion of the bracket has a flat surface opposing the rear wall of the unit, flanges embracing opposite sides of the unit and integral hooks engaged through said fastener receiving openings and establishing hooked engagement with said wall.

12 Claims, 14 Drawing Figures

INSTRUMENT MOUNTING FIXTURE

This invention has to do with a combination water bed structure and controlled water bed heating means with a control unit and is particularly concerned with a novel mounting fixture in combination with the bed structure and control unit, whereby said control unit is effectively mounted on and carried by the bed structure.

BACKGROUND OF THE INVENTION

The ordinary water bed comprises a bed frame including a flat horizontal mattress supporting platform and vertical side and end boards about the platform to retain a flotation mattress atop the platform within the confines of said boards. The ordinary flotation mattress is a water filled bladder of flexible plastic sheet material.

In the art of water beds, it is common practice to provide electric resistance heaters to heat and maintain the flotation mattresses at a desired temperature. The resistance heaters most commonly used in combination with water beds are flat blanket type heater units. These heater units are commonly laid flat between the bottom of the flotation mattresses and the supporting platforms of the bed frames.

It is also common practice to provide manually adjustable temperature control means for the heater units. The control means for water bed heaters generally include neat and compact box-like control units in which temperature control circuits are housed and which include a manually operable control knob accessible at the exterior of the box-like units. The control units are commonly connected with a power service cord extending from a power service outlet and are connected with the heaters by elongate power cords which extend from the control units into the bed structures and to the heaters. In addition to the above, many control means further include heat sensing devices engaged between the mattresses and the platforms and connected with the control units by elongate conductors.

The side boards of ordinary water bed frames are of considerable vertical extent, define extensive exterior surface and are established of wood or other construction materials which afford desirable supporting structures on which the heater control units can be effectively mounted as by screw fastener means. As a result of the foregoing, most commercially available water bed heater control units are small box-like units especially designed and constructed to be screw fastened to the exterior surfaces of the side boards of common water bed frames.

In the water bed art, there now exists water beds which consist of lower common or conventional box-spring units or platform units upholstered to appear as box springs, flotation mattress retaining means or units atop the box-spring units and flotation mattresses on and within the box-spring and retaining units. These water beds are commonly referred to or called hybrid water beds since they utilize certain components or parts of both common beds and water beds and seek to attain certain of the desirable attributes of both conventional and water beds. Specifically, in such water beds, the vertical extent or depth of the flotation mattresses are materially less than the vertical extent or depth of conventional water bed mattresses. This greatly reduces the volume and weight of water used. The reduced depth and volume of water also reduces the extent to which the water can surge in the resulting bed constructions and reduces undesirable residual wave action commonly experienced in such beds. The reduced volume and weight or mass of water also enables hybrid beds to be used in places where heavier conventional water bed structures cannot be used or are prohibited. Still further, hybrid bed structures require less time and energy to heat the mattresses.

As noted above, in hybrid water beds, conventional box-spring-like units are utilized. Conventional box-springs generally include lower flat horizontal rectangular wood frames which include laterally spaced longitudinally extending side beams, thin flat horizontal upper pads of soft flexible fibres in a fabric envelope spaced above the frames, a plurality of vertically compressible springs between the frames and the pads and flexible fabric covers about the exterior of and enclosing the assembled frames, pads and springs or like appearing platforms.

The flotation mattress retaining means or units provided for hybrid water beds vary widely in form. Such retaining means or units generally include horizontal rectangular weirs of resilient foam plastic engaged above and extending about the perimeters of the box-springs and central sheet-like lines of flexible plastic which overlie the box-spring units, inward of the weirs and which have edge portions which envelope the weirs and retain them in desired working position. In other retaining means or units, the weirs are established of tubular frames of heavy gauge flexible plastic sheet material, filled with water.

The flotation mattresses in hybrid water bed structures are simple bladders of flexible plastic sheet material slackily filled with water and are arranged in the upwardly opening recesses defined by the retaining units.

The heaters means provided to heat hybrid water beds commonly include flat horizontal blanket-type resistance heaters arranged between the tops of the box-spring units and the central sheet-like liners of the mattress retaining units to occur inward of the weirs and below the mattresses. The power cords for the heaters extend laterally outwardly from between the box-spring and the retaining units and connect with the small box-like temperature control units. Temperature sensing devices, which connect with the control units are also engaged between the box-springs and the mattress retaining units.

While the details of construction of the several components and/or parts of hybrid beds produced by different bed manufacturers vary considerably, the structure noted in the preceding is representative of most hybrid water beds, when considered in their broad aspects.

One characteristic found in the overwhelming majority of hybrid water bed structures is the absence of any structurally sound, hard and/or firm exterior or side surface of sufficient area or extent upon which the temperature control units can be effectively mounted and supported. The vertical exterior sides of the box-spring units are fabric and may be subject to flexure when the box-springs are yieldingly depressed and such that control units cannot be mounted therein. The vertical exterior sides of the mattress retaining units, defined by the weirs of those units, are soft and flexible and cannot be utilized as a support or mounting structure for anything.

Accordingly, neither the box-spring-like units, the retaining units, mattresses or bed frames of hybrid water beds of the general character referred to above present or normally provide any structure suitable for mounting the box-like control units provided for water bed heater means.

OBJECTS AND FEATURES OF THE INVENTION

An object and feature of the present invention is to provide a novel mounting fixture having a first portion to cooperatively receive and support a box-like heater control unit and a second portion remote from the first portion to cooperatively engage with the lower rigid wood frame of a related box spring-like unit whereby the control unit is securely and positively positioned adjacent one vertical side of the box-spring unit between the upper and lower planes thereof.

Another object and feature of the invention is to provide a novel mounting fixture of the character referred to above wherein the second portion of the fixture is cooperatively engaged about and between an angle iron rail of a related bed frame and the lower wood frame of a related box-spring unit engaged in and with said bed frame rail and wherein the first portion of the fixture projects upwardly from said second portion, rail and box-spring frame to occur adjacent to the exterior side of the box-spring unit, above the rail and below the top of said box-spring unit.

It is an object and feature of the present invention to provide a fixture of the character referred to above wherein the second lower portion has right angle flange portions to cooperatively engage with and about right angle related sides of a portion of the box spring frame and with and about the right angle inside surfaces of the angle iron rail of the bed frame.

Still another object and feature of the invention is to provide a fixture of the character referred to wherein the flange portions of the lower first portion have fastener receiver openings and screw fasteners engaged through those openings and into the wood frame of the box spring unit.

It is an object and feature of this invention to provide a fixture of the character referred to above wherein the first upper portion of the fixture is a flat vertical, rectangular plate-like portion in parallel relationship with the adjacent side of the box spring unit, substantially corresponds in plan configuration with the plan configuration of a related box-like heater control unit and has laterally spaced vertically extending flanges cooperating with the plate to define a laterally outwardly opening vertically extending channel in which the control unit is cooperatively seated.

Another object and feature of this invention is to provide a combination comprised of said bed frame, box spring unit, fixture and temperature control unit wherein the temperature control unit has a substantially flat vertical rear wall with fastener receiving apertures or openings opposing the plate-like portion of said fixture and fastening means on said fixture and engaged in said apertures or openings and releasably securing the temperature control unit to the fixture.

An object and feature of the invention is to provide a fixture of the character referred to which is an inexpensive to make unitary sheet metal part which is easy and quickly combineable with a related bed frame and/or box spring unit and with a related temperature control unit with the exercise of ordinary skill.

The foregoing and other objects and features of the invention will be fully understood from the following detailed description of one typical preferred form and application throughout which description reference is made to the accompanying drawings.

DETAILED DESCRIPTION OF THE INVENTION

Figure 1:
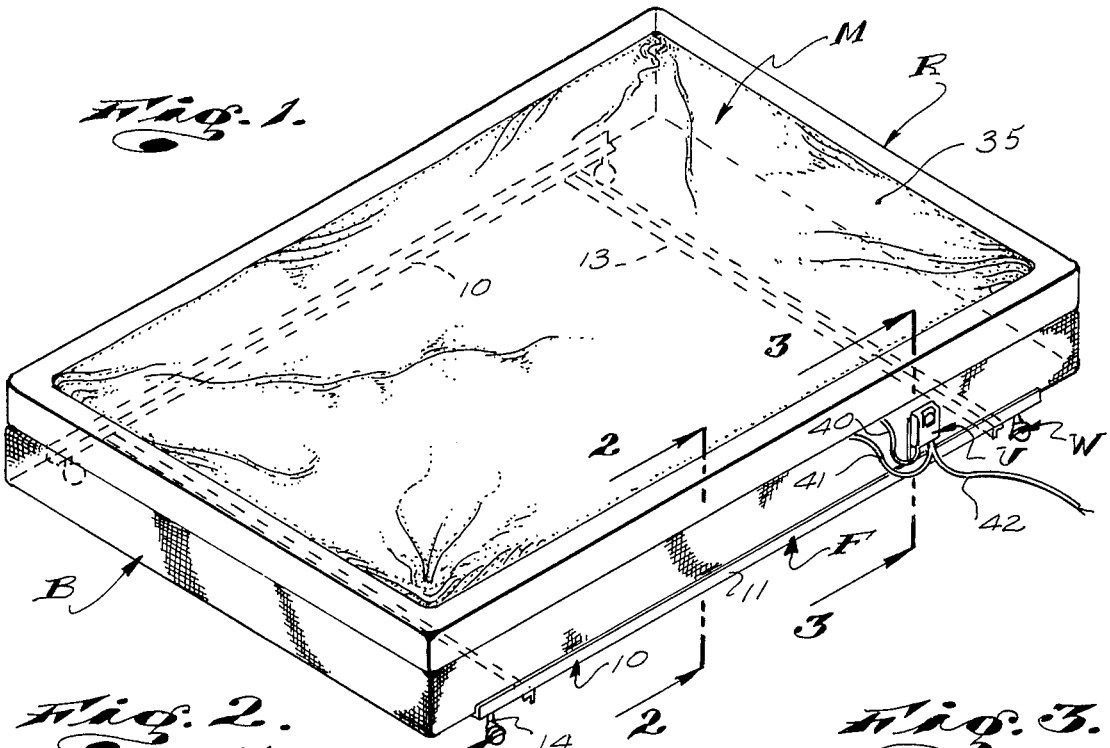
FIG. 1 is an isometric view of a water bed structure embodying the invention.

In FIG. 1 of the drawings, I have shown a water bed structure which is typical of that type or class of water bed structure which is commonly referred to as a hybrid bed.

The bed structure includes a lower bed frame F, a box spring unit B supported by the frame F, a mattress retainer unit R atop and supported by the box spring unit and a flotation mattress M within and contained by the retainer R.

The lower bed frame F is a conventional iron bed frame comprising a pair of laterally spaced elongate, longitudinally extending laterally inwardly and upwardly opening angle iron support members or rails 10 with outer vertical flanges 11 and lower, inner, horizontal flanges 12. The frame next includes two or more elongate, longitudinally spaced laterally extending angle iron spreaders 13 fixed to and extending between the lower flanges 12 of the rails to maintain the rails in fixed lateral position and in upright disposition. The frame next includes a plurality of vertical legs 14 fixed to and depending from the rails R and caster wheels W engaged in and with the lower ends of the legs to rollingly support the frame F on and above a related floor (not shown).

Standard bed frames of the character referred to above are most commonly established of $1\frac{1}{4}''$ by $1\frac{1}{4}''$ angle iron stock.

While other forms of bed frames can be employed in carrying out this invention, the type or class of iron frame shown and described above is the most widely used and well known form of bed frame suitable for use in carrying out the invention.

The important features of the frame F, as it affects the present invention, is the noted provision of laterally spaced longitudinal side rails with outer vertical flanges to engage and retain the lower side edge portions of the lower frames of related box spring units and horizontal bottom flanges to engage beneath and support the lower edges of said box spring frames.

(In practice, wood bed frames which are the equivalent of the noted iron bed frames are sometimes provided. In such wood frames, the equivalent of the vertical flanges are defined by wood boards and the bottom horizontal flanges are defined by wood cleats fixed to the boards).

The box-spring-like unit B is a typical or conventional box spring unit such as is used in conventional bed structures and includes a lower horizontal rectangular wood frame 20 including laterally spaced longitudinally extending support members or side beams 21, transversely extending end spreaders or beams 22, and a plurality of longitudinally spaced transversely extending spring supporting intermediate spreaders or bats 23 with opposite ends fixed atop the side beams. The rectangular wood frame 20 is necessarily of limited vertical extent and may, as shown, support a plurality of upwardly projecting, vertically, depressible springs 25, which springs support a bedding pad 26.

In practice, for example, the beams 21 and 22 and bats 23 of the frame 20, are established of flat 1" by 3" wood stock. Accordingly, the mean vertical extent of the frame is approximately 1" and close to being the same in vertical extent as the rails of the bed frame F.

The several wood parts of the box spring frame are most often fixed together by simple nails, metal staple fasteners, or the like. It is necessary that the frame 20 of the unit B be of limited vertical extent to permit downward depressing of the springs 25 and pad 26 without interference.

The pad 26 of the box spring unit B typically consists of a flat rectangular fabric envelope 27 filled with cotton batting, linter or other suitable padding material 27'.

The springs 25 of the unit B are most commonly simple vertically extending helical wire springs, the lower ends of which are fixed to the bats 23 of the frame 20 as by staples and the upper ends of which engage the bottom of and support the pad 26. The springs are oftentimes engated in fabric socks 28 and the upper and lower related ends of adjacent springs are commonly coupled together as by wire links and the like (not shown) to maintain the springs in desired spaced relationship with each other.

Finally, the box spring unit B, in accordance with most common practice, is enclosed by a fabric jacket or cover 29, which cover extends about all six sides of the unit and serves to retain the various parts of the construction in desired position and serves an obvious and desirable aesthetic end.

While the details of construction of box spring units produced by different manufacturers vary considerably, they all, characteristically, include a thin, flat wood frame, a pad spaced above the frame and springs between the frame and the pad, substantially as shown and described above.

In use, when downwardly directed weight or forces are applied onto and through the box spring unit B, the pad 26 is urged and moved downwardly, yieldingly biasing the springs downwardly, toward the frame 20. Accordingly, in use, the vertical extent of the box spring unit is subject to considerable variation and the major vertical extent of the sides thereof (about the frame 20) are non-stable, movable and such that they afford no structure upon which any related device such as a heater control unit might be fixedly mounted.

Figure 2:
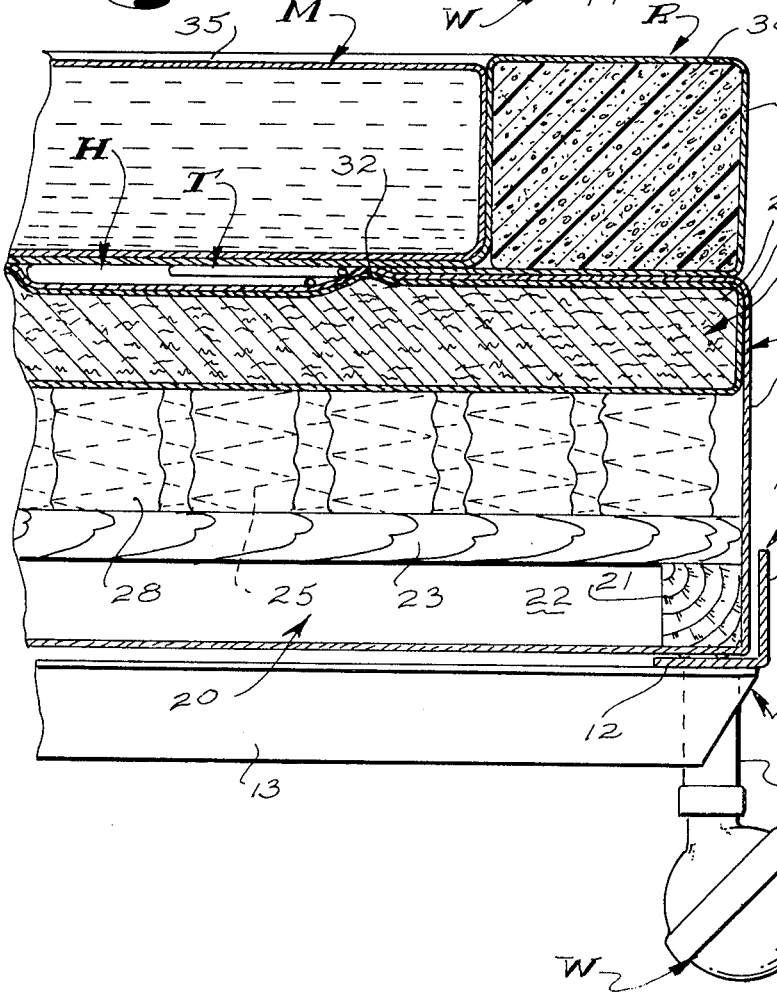
FIG. 2 is an enlarged detailed sectional view of a portion of the bed structure taken substantially as indicated by line 2—2 on FIG. 1.
Figure 3:
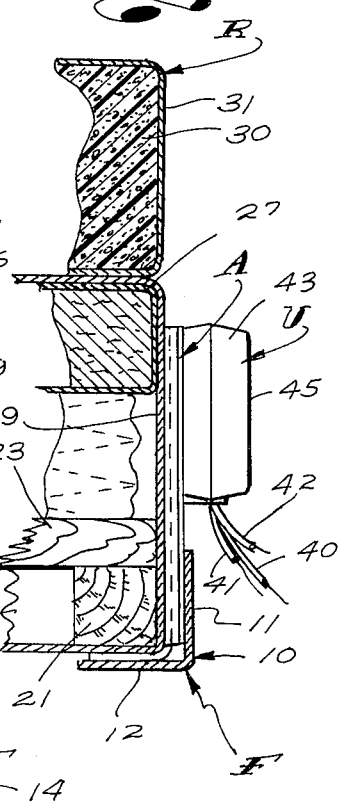
FIG. 3 is an enlarged detailed sectional view taken substantially as indicated by line 3—3 on FIG. 1.
Figure 4:
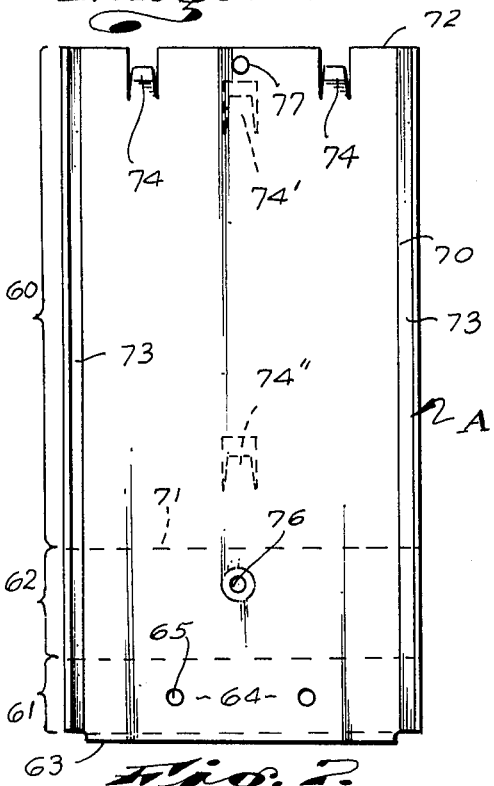
FIG. 4 is a front view of the fixture provided by the present invention.
Figure 5:
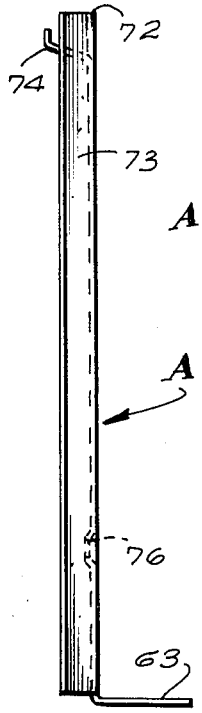
FIG. 5 is a side view of the fixture.
Figure 6:
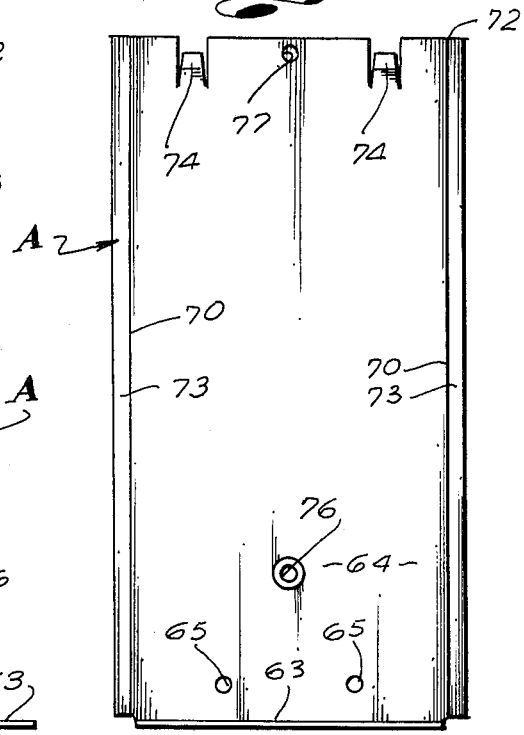
FIG. 6 is a rear view of the fixture.
Figure 7:
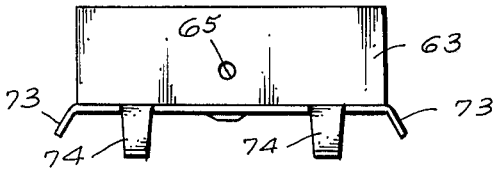
FIG. 7 is a top view of the fixture.
Figure 8:
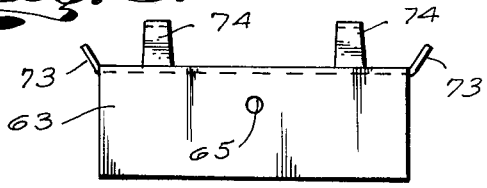
FIG. 8 is a bottom view of the fixture.

In practice, when the box spring unit B is related to the bed frame F, the side beams 21 of the unit B are engaged and set atop the lower horizontal flanges 12 and are engaged and retained against lateral displacement by the outer vertical flanges 11 of the rails 10, as clearly shown in FIG. 2 of the drawings.

The mattress retaining unit R used in combination with the box spring-like unit B in hybrid water bed structures vary considerably in construction. As shown in the drawings, the retaining unit R includes a rectangular outer frame like weir 30 of soft resilient foam plastic corresponding in outside dimensions with the outside dimensions of the box spring unit and in vertical extent and in inside dimensions with the vertical extent and outside dimensions of the flotation mattress M. The wier 30 is covered with a jacket or outside skin 31 of flexible vinyl plastic or the like. The jacket 31 is formed integrally with a flat horizontal central liner 32. The sheet plastic liner 32 is coextensive with the inside dimensions of the wier and engages the top of the box spring unit B. The liner 32 in addition to holding the weir against lateral displacement cooperates with the jacketed weir to establish an upwardly opening water proof basin in which the mattress M is arranged and which is such that it will hold and retain water spilled or leaked from the mattress.

Another and widely used form of mattress retainer consists of a wier in the form of a tubular flexible plastic frame about a central liner, which frame is filled with water. This second and popular form of retainer functions in the same manner that the retaining unit R functions, but provides a more yieldable frame work about the mattress M.

The mattress M is a flat horizontal rectangular unit comprised of a bladder 35 of flexible plastic sheeting and is slackily filled with water. The mattress M has a flat normally horizontal top wall upon which persons lying on the bed are supported, vertical side and end walls which engage the inner sides of the weir and a flat horizontal bottom wall engaged and supported on the liner 32 of the unit R and atop the box spring unit B.

In recent times, certain hybrid water bed structures have been provided wherein the retaining means about the mattress are built into or formed integrally with the mattress. In such structures, the retaining means and mattresses are not distinguishable and are in effect special hybrid flotation mattresses.

In use, when a person is engaged atop the mattress M, the weight of his body displaces water and depresses the top wall of the bladder until his body is buoyed up and supported. Should he be too heavy or should he move or otherwise concentrate excessive forces on the mattress so as to cause the top wall thereof to bottom out on and against the bottom wall thereof, the box spring unit B is yieldingly depressed and moved downwardly to absorb the excessive forces and accommodate the bulk of the lowermost parts and/or portions of the person's body.

The foregoing structure is old in the prior art and is typical of most hybrid water bed structures.

In addition to the above, and in accordance with preferred and common practices, the hybrid bed is provided with temperature control means C to heat and maintain the temperature of the mattress at a desired temperature. The means C first includes a resistance heater H to heat and maintain the water in the mattress M at a desired temperature and a manually adjustable control unit U for the heater. The heater H is preferably a flat horizontal blanket type heater (though other forms of heaters can be used) and is arranged between the top of the box spring unit B and the liner 32 of the retaining unit R so that heat generated by the heater is effectively conducted upwardly through the liner, the bottom wall of the mattress bladder and into the water within the bladder. The heater H is supplied with current by a power cord 40 which extends laterally outwardly from the heater and from between the retaining unit R and the box spring unit B, at one side of the construction and which connects with the control unit U.

In practice, a temperature sensing device T can be arranged between the retaining unit R and the box spring unit B to monitor the temperature of the mattress, or the water therein. The device T has a conductor line 41 which like the cord 40 extends laterally outwardly from between the retaining unit R and the box spring unit B, at one side of the construction and connects with the unit U.

The unit U, in accordance with common practice, is a small rigid box-like unit with which the cord 40 and conductor line 41 connect and from which an elongate service cord 42 extends. The service cord 42 is adapted to extend to and connect with a domestic power service outlet (not shown) in the building in which the construction is used.

Figure 9:
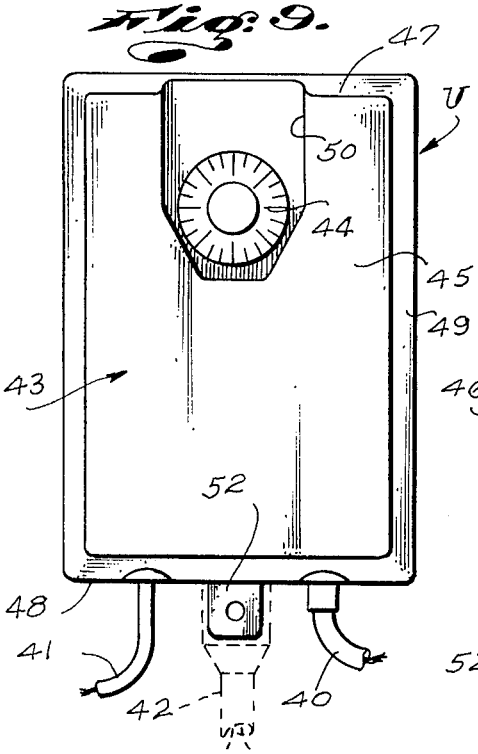
FIG. 9 is a front view of the temperature control unit.
Figure 10:
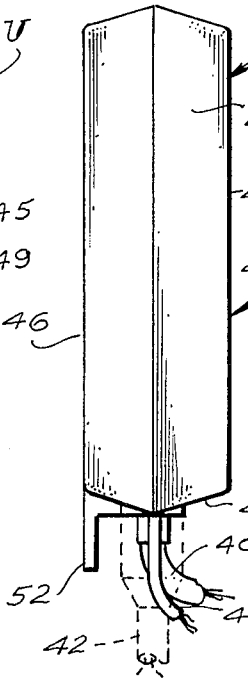
FIG. 10 is a side view of the temperature control unit.
Figure 11:
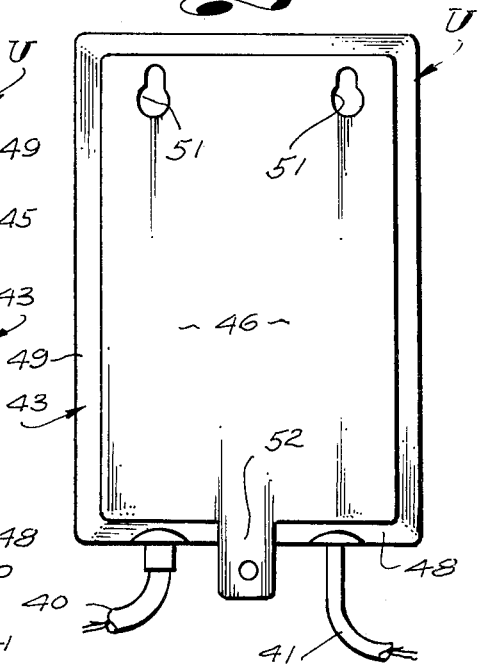
FIG. 11 is a rear view of the temperature control unit.

Referring to FIGS. 9, 10 and 11 of the drawings, the unit U includes a box-like housing 43 of molded plastic or the like, in which a suitable temperature responsive power control circuit is arranged and has or carries a manually engageable control dial or knob 44.

In the case illustrated, the housing 43 of the unit U has flat vertical front and rear walls 45 and 46 and top, bottom and side walls 47, 48 and 49. The front wall 45 has a forwardly and upwardly opening recess 50 in which the control knob 44 is engaged. The conductor 40 and cords 41 and 42 extend through and from openings in the bottom wall 48 of the housing and the rear wall 46 of the housing has fastener receiving openings 51 to accommodate fasteners (not shown) to secure and effectively mount the unit to a related bed structure. The openings 51, in accordance with common practice, are key-hole openings to receive the head and shank portions of mounting screws (not shown) which are commonly provided with such units to effect mounting them on the exterior surfaces of the side rails of conventional water bed frames.

Instead of or in addition to the openings 51, the unit housing can be provided with one or more outwardly projecting apertured mounting tabs 52 on the plane of the rear wall 46 to facilitate mounting the unit on a related bed structure with screw fasteners.

The unit U shown in the drawings and briefly described above measured about 5" by 3½" by 1½" and is, to the extent that it is described above, essentially the same as the majority of control units for water bed heaters provided throughout the water bed industry. But for small dimensional variations and slightly differences in design and in the arrangements of fastener receiving openings 51 in the back walls of the unit housings and/or the arrangement of apertured mounting pads 52, most heater control units for water beds are essentially the same as the unit U shown and described above.

In practice, due to the nature and use of the control units for water bed heaters and the manner in which the conductors and cords extend therefrom, it is most desirable and strongly recommended that they be securely mounted on the exterior sides of their related beds so as to overcome the likelihood that they might be forcibly moved about in such a manner as to cause damage to the units and/or to the cords and conductors related thereto, or cause damage to their related bed structures.

Referring specifically to FIG. 2 of the drawings, it will be apparent that the conventional hybrid water bed structure provides no structure defining a suitable surface upon which a standard or conventional water bed heater control unit such as the unit U illustrated in the drawings and described above can be effectively mounted. Accordingly, prior to the present invention, in the case of hybrid water beds, the heater control units have simply been left to hang or dangle from their related lines and cords at a side of their related bed structures. Such handling and treatment of the control units has resulted in frequent damage to the units, fatiguing and breaking of the lines and cords and has made access to and manual operation of the units extremely inconvenient. Further, such handling and treatment of the control units is extremely unattractive and make-shift in appearance.

The present invention provides a novel mounting fixture A specifically designed for use in direct combination with the bed frame F, box spring unit B and temperature control unit U of a hybrid water bed structure such as is shown in the drawings and described in the foregoing.

It is to be noted that while the flotation mattress M and retaining unit U of the bed structure form parts of the overall combination, they are indirectly related with the bed frame F, fixture A and the unit U.

Referring specifically to FIGS. 4 through 8 of the drawings, the mounting fixture A is a simple and easy to make unitary sheet metal part and includes a flat vertical upper control unit mounting portion 60, a lower box spring frame and bed frame rail engaging portion 61 and a vertically extending intermediate portion 62. The beam and rail engaging portion 61 is an angle portion comprising a flat inner elongate horizontal lower flange 62 to engage the bottom surface of a related beam 21 of its related box spring unit B and to engage the top surface of its related lower inner flange 12 of its related bed frame rail 10, and an outer elongate vertical flange 64 engaging the outside surface of its related beam 21 and the inside surface of its related vertical rail flange 11. The beam and rail engaging portion 61 is, when in use, engaged about the lower outside corner of its related beam 21 and is seated within its related angle iron rail 10 to be held substantially captive between said beam and rail. (The spaces between parts shown in the drawings are provided to better distinguish those parts and better illustrate the invention).

Figure 12:
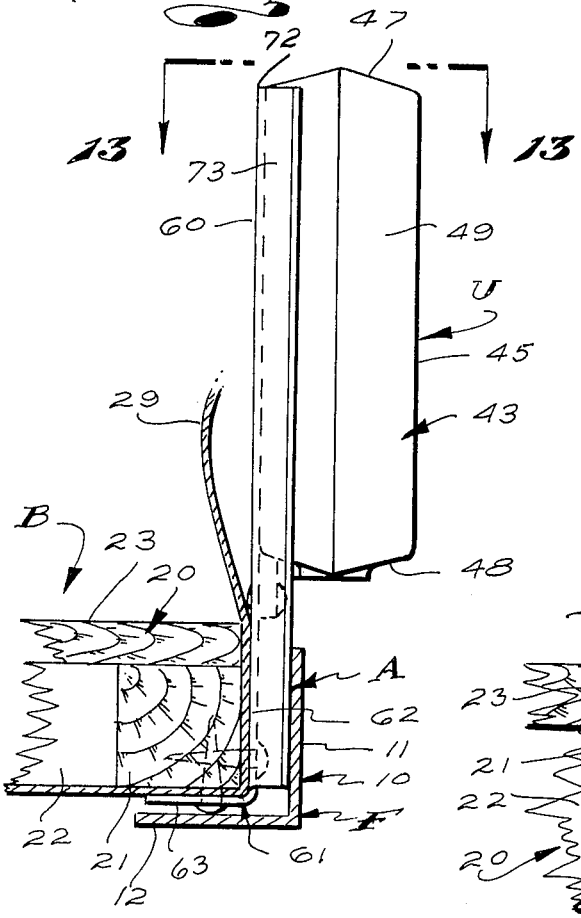
FIG. 12 is an enlarged view of a portion of the structure shown in FIG. 3.
Figure 14:
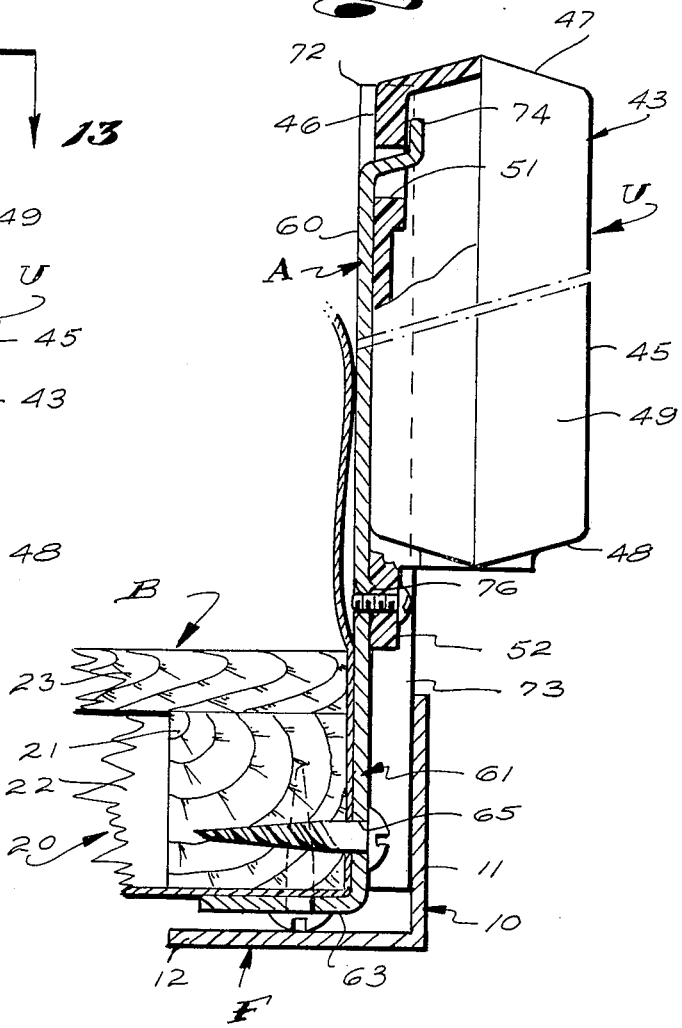
Figure 13:
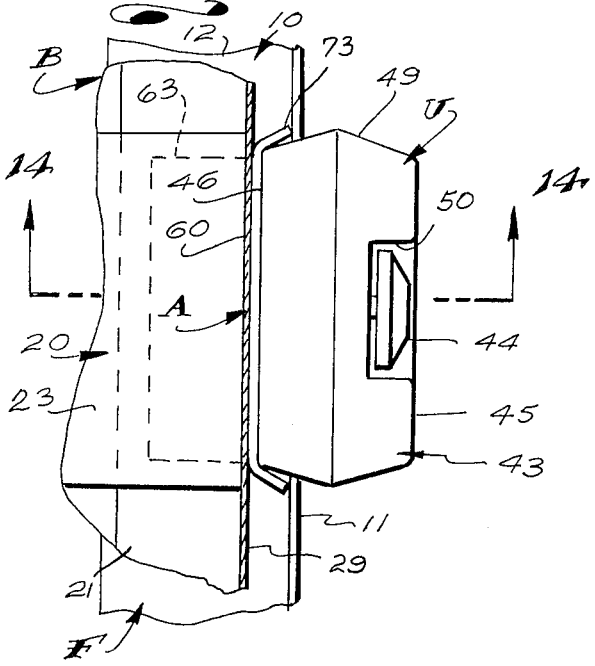
FIG. 13 is a top view taken as indicated by line 13—13 on FIG. 12.

In practice, the flanges 63 and 64 are provided with fastener receiving through openings 65 through which nails or wood screw fasteners 66 are engaged to releasably secure the fixture in desired position on and with the beam 21 of the box spring unit B (best shown in FIGS. 12 and 14 of the drawings).

The upper control unit mounting portion 60 of the fixture is a substantially flat rectangular portion having vertical sides 70, a bottom 71 and a horizontal top 72.

The portion 60 corresponds generally in plan configuration with the housing 43 of the unit U, or with the back wall 46 of said housing. The portion 61 and back wall 46 of the housing normally establish opposing supporting engagement with each other. The portion 60 preferably has forwardly turned and projecting longitudinal reinforcing flanges 75 formed integrally with and along its vertical side edges 70. The flanges serve to reinforce and stiffen the fixture and also occur outward of and adjacent the side walls 49 of the unit U to prevent lateral displacement and turning of the unit U relative to the fixture.

In addition to the above, the portion 60 of the fixture A includes a plurality of forwardly and upwardly projecting hook-like hangers 74 arranged to enter and establish supporting hooked engagement in the fastener receiving openings 51 in the rear wall 46 of the unit U, whereby the unit U, when moved rearwardly and downwardly into engagement with the fixture establishes hooked engagement with and is supported by the hangers against excessive downward and/or lateral displacement relative thereto.

While the hangers 74 are shown formed in the upper edge portion of the portion 60, to accommodate the particular unit U shown in the drawings, it will be apparent that their arrangement can be altered to accommodate other makes and/or forms of control units. For example, they might be arranged as shown in dotted lines, at 74', in FIG. 4 of the drawings.

In practice, the structure thus far described is generally sufficient to satisfactorily mount the unit U with the portion 60 of the fixture A. In practice, when the unit U includes a mounting pad such as is shown at 65 in the drawings, the portions 60 can be provided with a fastener receiving opening 76 to facilitate securing the tab to the fixture by means of a screw fastener, as shown in FIG. 14 of the drawings. This secondary fastening means holds the unit U down and in secure hooked engagement with the hangers 74.

Further, in practice, it might be desirable to provide one or more fastener openings 77 in the portions 60 as supplements to or in place of the hangers 74 and to accommodate certain available control units which are only provided with mounting pads similar to the pads 52 or with through openings to accommodate mounting screws. By appropriately arranging fastener openings and/or hangers, such as referred to above, the fixture can be established to effectively mount several different makes and/or models of control units.

The intermediate portion 62 of the fixture A is a vertical extension of the portion 60 and/or of the flange 64 of the portion 61 and is of sufficient vertical extent to position the portion 60 and the unit related thereto above and clear of the upper edge of the flange 11 of the bed frame rail 10. The unit is substantially less in vertical extent than the vertical extent of the box spring unit B and the vertical extent of the portion 62 of the fixture A is such that the upper edge 72 of the portion 60 and top wall 47 of the unit U are spaced below the top plane and are laterally outward of the box spring unit B and retaining unit R carried by the unit B so that the fixture and the unit U do not and cannot establish interferring engagement with the units B and R during normal use of the bed structure.

It will be noted that in the form of the invention illustrated, the rear portion of the side walls 49 of the unit U are inclined laterally outwardly and forwardly and that the flanges 73 of the fixture A are therefore inclined in a like manner to cooperatively and effectively engage said side walls of the unit.

With the fixture A here provided, it will be apparent that when it is cooperatively related with the units U and B and with the frame F, as shown, a new and novel combination and relationship of parts is established wherein the unit U is effectively securely mounted on and relative to the unit B and/or the frame F, which desired mounting of such a unit cannot be otherwise attained.

In practice, it is not infrequent that the bed frames F noted above are not utilized. In such cases, the box spring units B set and are supported directly upon the floor with which the hybrid beds are related. In such cases, the fixture A is related only to the frame 20 of the box spring unit B and is effective to securely mount the heater control unit U relative thereto.

In the drawings and foregoing description of the invention, a bed structure including a common or conventional type of box-spring has been illustrated and described. In the art of water beds, it is not infrequent that box-springs, such as referred to above, are not provided and in their stead, platform structures comprising lower open wood frames with upper flotation mattress supporting panels are provided. These platform structures present the same difficulties and problems respecting the mounting of heater control units as are found in common box springs, which difficulties and problems are effectively overcome through the use of the new fixture or bracket A provided by the present invention.

Still further, many new water bed structures include thin flat horizontal flotation mattress platforms with foam plastic mattress retaining weirs about the perimeters of and projecting upwardly from the platforms. The foam plastic weirs are such that they cannot provide adequate or suitable support for heater control units. In such structures, the bracket or fixture A provided by the present invention can be effectively related and secured to the platforms to effectively mount the control units adjacent the outside surfaces of the weirs.

Having described only typical preferred forms and applications of the invention, I do not wish to be limited to the specific details herein set forth but wish to reserve to myself any modifications and/or variations that may appear to those skilled in the art and which fall within the scope of the following claims.

Having described our invention, we claim:

1. In combination, a mattress supporting box-spring comprising a lower flat horizontal wood frame with longitudinal side beams with downwardly and laterally outwardly disposed surfaces, a soft flexible normally flat horizontal pad in vertical spaced relationship above the frame and spring means between the frame and the pad; a soft flexible mattress above and supported by the pad; an electric resistance heater adjacent the mattress to maintain the mattress at a desired temperature; a temperature control unit for the heater positioned outward of and adjacent one side of the box-spring; a power cord extending from the control unit to the heater and a service cord extending from the unit to a power supply; and a unitary mounting fixture mounting the control unit adjacent said one side of the box-spring unit between the top and bottom planes thereof and comprising a lower portion with a lower horizontal flange adjacent and fastened to the lower surface of a related beam and a vertical flange adjacent and fastened to the outside surface of that beam; an upper plate portion with a laterally outwardly disposed outer surface laterally outward of the box-spring and a vertical intermediate portion integrally joining said upper and lower portions; said control unit includes a housing with a rear surface positioned adjacent said outside surface of the plate; and means carried by the plate releasably securing the housing to said plate.

2. The combination set forth in claim 1 wherein said housing is box-like structure with a vertical rear wall defining said rear surface and having oppositely disposed vertical side walls; said plate has vertical forwardly projecting reinforcing and retaining flanges in retaining engagement with said side walls of the housing.

3. The combination set forth in claim 1 wherein said control unit has a rear wall with spaced fastener receiving openings and which defines said rear surface, said plate has forwardly and upwardly projecting hangers engaged through said openings and establishing hooked engagement with said rear wall.

4. The combination set forth in claim 2 wherein said rear wall has spaced fastener receiving openings and said plate is formed with outwardly and upwardly projecting hangers engaged through said openings and establishing hooked engagement with said rear wall.

5. The combination set forth in claim 1 which further includes a floor engaging bed frame supporting the box-spring in spaced relationship above a related floor and including a pair of elongate side rails with lower horizontal support flanges opposing the lower surface of said beams and vertical retaining flanges opposing the outer surfaces of said beams, said horizontal and vertical flanges of said fixture are engaged and retained between their related surfaces of their related beam and side rail.

6. The combination set forth in claim 5 wherein said housing is a box-like structure having a vertical rear wall defining said rear surface and having oppositely disposed vertical side walls; said plate has vertical forwardly projecting reinforcing and retaining flanges in retaining engagement with said side walls of the housing.

7. The combination set forth in claim 5 wherein said control unit has a rear wall with spaced fastener receiving through openings and defines said rear surface, said plate has forwardly and upwardly projecting hangers engaged through said openings and establishing hooked engagement with said rear wall.

8. The combination set forth in claim 6 wherein said rear wall has spaced fastener receiving through openings and said plate is formed with outwardly and upwardly projecting hangers engaged through said openings and establishing hooked engagement with said rear wall.

9. In combination, an elongate vertical mounting fixture engageable with and between a lower elongate horizontal support member and an upper control unit spaced vertically above and laterally outward from said member; said member has a substantially flat horizontal lower surface and a substantially flat vertical outer surface outward of and extending upwardly from the lower surface; said control unit has a substantially flat vertical laterally inwardly disposed rear surface on a plane substantially parallel with and laterally outward of the plane of said outer surface, said fixture has a lower portion with an outer vertical flange in bearing engagement with said outer surface and a horizontal laterally inwardly projecting lower flange in bearing engagement with said lower surface; means holding said lower portion engaged with said member; a substantially flat, vertical upper plate portion spaced above the lower portion, said upper portion has a laterally outwardly disposed surface opposing and engaging the rear surface of the control unit; means releasably securing the control unit engaged with said upper portion; and, a vertical intermediate portion formed integrally with and joining said upper portion with the outer flange of the lower portion.

10. The combination set forth in claim 9 wherein the means holding the lower portion engaged with said member includes a second support member with lower and outer surfaces opposing the lower and outer surfaces of the first member with the flanges of said lower portion retained therebetween, one of said members is a longitudinally extending laterally inwardly and upwardly opening angle iron side rail of a rectangular bed frame structure and the other of said members is a longitudinally extending side beam of a box spring frame supported by the bed frame.

11. The combination set forth in claim 9 wherein the means releasably securing the control unit engaged with the upper portion of the fixture includes spaced forwardly and upwardly projecting hook-like hangers formed in said upper portion and said control unit has a rear wall defining said rear surface and having spaced openings therein, said hangers project through said openings and establish hooked engagement with said wall.

12. The combination set forth in claim 10 wherein the means releasably securing the control unit engaged with the upper portion of the fixture includes spaced forwardly and upwardly projecting hook-like hangers formed in said upper portion and said control unit has a rear wall defining said rear surface and having spaced openings therein, said hangers project through said openings and establish hooked engagement with said wall.

* * * * *